US007905371B1

(12) United States Patent
Mohoney

(10) Patent No.: US 7,905,371 B1
(45) Date of Patent: Mar. 15, 2011

(54) LABEL DISPENSER

(76) Inventor: Victor Mohoney, Madison, WI (US)

( * ) Notice: Subject to any disclaimer, the term of this patent is extended or adjusted under 35 U.S.C. 154(b) by 753 days.

(21) Appl. No.: 11/843,373

(22) Filed: Aug. 22, 2007

(51) Int. Cl.
*B65H 5/28* (2006.01)

(52) U.S. Cl. ..... 221/73; 221/70; 221/71; 221/72; 221/311; 156/577

(58) Field of Classification Search ..... 221/73, 221/72, 71, 70, 311, 74, 22, 33, 84–86; 156/577
See application file for complete search history.

(56) References Cited

U.S. PATENT DOCUMENTS

| | | | | | |
|---|---|---|---|---|---|
| 2,569,140 | A | * | 9/1951 | Avery | 156/536 |
| 3,222,242 | A | * | 12/1965 | Ingalls et al. | 156/584 |
| 3,283,886 | A | * | 11/1966 | Addis et al. | 242/588.6 |
| 3,686,055 | A | * | 8/1972 | Hermann | 156/384 |
| 4,336,097 | A | * | 6/1982 | Van Kampen et al. | 156/527 |
| 4,704,185 | A | | 11/1987 | Fischer | |
| 4,770,322 | A | | 9/1988 | Slota et al. | |
| 4,821,918 | A | * | 4/1989 | Turner | 221/70 |
| 4,954,210 | A | | 9/1990 | Desmond | |
| D347,243 | S | | 5/1994 | Thomas-Cote et al. | |
| 5,634,570 | A | | 6/1997 | Casper et al. | |
| D398,646 | S | | 9/1998 | Geiger | |
| 5,806,713 | A | * | 9/1998 | Dudley et al. | 221/73 |
| 5,806,714 | A | | 9/1998 | Geiger | |
| 5,851,347 | A | * | 12/1998 | Rodriguez | 156/576 |
| 5,851,348 | A | * | 12/1998 | Muenzer et al. | 156/577 |
| D407,750 | S | | 4/1999 | Watters | |
| 6,029,849 | A | * | 2/2000 | Meshulam | 221/26 |
| D422,312 | S | | 4/2000 | Bronwasser | |
| D442,637 | S | | 5/2001 | Dorrell et al. | |
| D510,387 | S | | 10/2005 | Lynn et al. | |
| 7,036,546 | B1 | | 5/2006 | Ripma | |
| D567,292 | S | * | 4/2008 | Mohoney | D19/69 |
| 2007/0138197 | A1 | * | 6/2007 | Kan | 221/42 |

* cited by examiner

*Primary Examiner* — Gene Crawford
*Assistant Examiner* — Michael K Collins
(74) *Attorney, Agent, or Firm* — Craig A. Fieschko, Esq.; DeWitt Ross & Stevens S.C.

(57) ABSTRACT

A label dispenser for storing adhesive labels provided in a roll on a backing strip, and for applying such labels to a substrate, includes a spool wherein the roll may be fit, with the label-bearing strip being fed out of a feed opening in the spool and onto a feeding surface on the outside of the spool. The label-bearing strip is then directed onto and about a peeling lip, causing the strip to shed its label(s) as it traverses the lip. The label is then applied to any adjacent substrate, while the label-less backing strip is directed between a roller (which rolls on the substrate) and a receiving surface on the outside of the spool. As the roller rolls on the substrate, it serves to grasp the label-less backing strip and pull the label-bearing strip out of the spool interior, where it then deposits labels on the substrate as it traverses the lip.

24 Claims, 8 Drawing Sheets

LABEL DISPENSER

FIELD OF THE INVENTION

This document concerns an invention relating generally to dispensers for adhesive labels, and more specifically to label dispensers which automatically dispense adhesive labels onto a substrate from a roll of labels when such dispensers are slid or otherwise run over the substrate.

BACKGROUND OF THE INVENTION

Consumers are more frequently using adhesive labels in their households, with postage stamps and address labels being a common example. These adhesive labels are generally provided in the form of labels with a gummed rear face adhered to a peelable backing strip, with the label-bearing strip being rolled up so that consumers may unroll the strip and peel off labels for application to a substrate as needed. Such adhesive labels are far more convenient to use than labels which require the application of moisture prior to use, as in the case of "lick-and-stick" labels backed with dry adhesive. The rolled form of such adhesive labels is also useful because the rolls are not as easily misplaced as sheets of labels (which are often "buried" amidst the user's papers), and the rolls also expose fewer of the faces of the labels to soiling and damage. However, rolls of adhesive labels can also be inconvenient in that they tend to uncoil unless they are restrained into their rolled form, and the uncoiled roll then occupies excessive space and presents a messy appearance. It is therefore useful to have devices available for storing and dispensing adhesive labels.

SUMMARY OF THE INVENTION

The invention involves a label dispenser having a variety of advantageous features. To give the reader a basic understanding of some of these advantageous features, following is a brief summary of a preferred version of the label dispenser. Since this is merely a summary, it should be understood that more details regarding this and other versions of the invention may be found in the Detailed Description set forth elsewhere in this document. The claims set forth at the end of this document then define the various versions of the invention in which exclusive rights are secured.

Referring to FIG. 1 for a view of a preferred version of the label dispenser in fully assembled form, the label dispenser 100 has a central spool 102 from which labels are dispensed from a rolled label-bearing backing strip, a pair of opposing dispenser sides 104 which assist in maintaining the strip on the spool 102, and a roller 106 which can be rolled across the substrate to which the label is to be applied, with the roller 106 assisting in feeding the strip from the spool 102 and peeling the labels from the backing strip for application to the substrate. The spool 102, which extends between the dispenser sides 104, includes an inner spool circumference 108 bounding a hollow spool interior 110 wherein the label-bearing roll may be situated (see particularly FIGS. 2, 3, 4A-4B, and 5A-5B), and an opposing outer spool circumference 112 (see particularly FIGS. 2, 4A, and 5A). The outer spool circumference 112 can be regarded as including three sections: a feeding surface 114 following a convex curve, against which a label-bearing strip unspooling from the spool interior 110 may be fed (consider, for example, a roll of labels situated within the spool interior 110 of FIG. 4A and unspooling in a counterclockwise direction against the feeding surface 114); a peeling lip 116 which protrudes outwardly from the feeding surface 114, with the peeling lip 116 promoting the release of adhesive labels from the backing strip as the backing strip is fed from the feeding surface 114 and around the peeling lip 116; and a receiving surface 118 following a convex curve away from the peeling lip 116 in a direction opposite that of the feeding surface 114, against which the label-less backing strip may be received after being fed from the feeding surface 114 and about the peeling lip 116. Looking particularly to FIGS. 4A and 5A, it is seen that the feeding surface 114 and receiving surface 118 together define an at least substantially cylindrical surface, with the peeling lip 116 extending radially outwardly between the feeding surface 114 and the receiving surface 118. The cylindrical surface defined by the feeding surface 114 and receiving surface 118 is not complete, since a feed opening 120 extends between the inner spool circumference 108 and the outer spool circumference 112 between the feeding surface 114 and receiving surface 118 opposite the peeling lip 116 (see particularly FIGS. 3, 4A, and 5A), whereby the label-bearing strip may be unspooled through the feed opening 120 from the roll of labels situated within the spool interior 110. This feed opening 120 is bounded on opposing sides by a first side 122 and a second side 124 which extend between the opposing dispenser sides 104, wherein the feeding surface 114 extends from the first side 122 of the feed opening 120 toward the peeling lip 116, and the receiving surface 118 extends from the second side 124 of the feed opening 120 toward the peeling lip 116.

As best seen in FIGS. 4A-4B and 5A-5B, the dispenser sides 104 extend radially outwardly from the spool 102 to terminate in dispenser edges 126, with the dispenser sides 104 thereby defining barriers which help to restrain a label-bearing strip (and the label-less backing strip) on the spool 102. As best envisioned with reference to FIG. 1, the dispenser sides 104 may bear a central aperture 128 so that a user may view the presence of a roll of labels within the spool interior 110.

Referring particularly to FIGS. 2 and 3, the roller 106 is rotatably mounted between the dispenser sides 104 within a concave receiving region 130 defined between the receiving surface 118 and the peeling lip 116, with the concave receiving region 130 being best seen in FIGS. 4A and 5A. Referring back to FIG. 2, the roller 106 has opposing roller ends 132 with a roller circumference 134 extending therebetween, with the roller circumference 134 preferably having a surface frictionally adapted to grasp a label-less backing strip. The dispenser sides 104 bear opposing cavities 136 (see particularly FIGS. 2, 4A-4B, and 5A-5B) wherein the roller ends 132 are rotatably situated within the cavities 136 (see FIG. 1). When the roller ends 132 are so mounted, a portion of the roller circumference 134 extends inwardly from the dispenser edges 126 toward the outer spool circumference 112, and the remainder of the roller circumference 134 extends outwardly beyond the dispenser edges 126, whereby the roller 106 protrudes from between the opposing dispenser edges 126. The roller ends 132 are also preferably translatably situated within the cavities 136 so that the roller 106 may be displaced by a small amount toward the receiving surface 118 on the outer spool circumference 112 when pressed in this direction. As will be discussed below, this assists in the dispensation of labels from a roll provided within the dispenser.

A strip infeed restraint 138 is preferably provided (see particularly FIGS. 1, 2, 4A, and 5A) wherein the strip infeed restraint 138 extends between the dispenser sides 104, and adjacent to (and spaced from) the feeding surface 114 and peeling lip 116. A label-bearing strip fed along the feeding surface 114 from the spool interior 110 may therefore be received between the strip infeed restraint 138 and the peeling lip 116. The strip infeed restraint 138 preferably has a window 140 defined therein (see particularly FIG. 1), with the window 140 being situated opposite the feeding surface 114, so that a user may readily see the faces of the labels being dispensed (for example, to verify the denomination of stamps borne on the backing strip being fed across the feeding surface 114). As perhaps best envisioned with reference to FIGS. 3 and 5A-5B, the strip infeed restraint 138, the receiving surface 118, and the feeding surface 114 preferably curve along a shared spiral path, with the feeding surface 114 extending to the receiving surface 118, and the receiving surface 118 then extending to the strip infeed restraint 138, with the strip infeed restraint 138 curving adjacent to, and radially outwardly from, the feeding surface 114 of the outer spool circumference 112.

The dispenser also preferably includes a strip outfeed restraint 142 (best seen in FIGS. 1, 2, 4A, and 5A-5B) which extends between the dispenser sides 104 within the concave receiving region 130, and adjacent to and spaced from the receiving surface 118. The strip outfeed restraint 142 is spaced from the peeling lip 116 so that the roller 106 rests between the strip outfeed restraint 142 and the peeling lip 116. Thus, once the backing strip sheds its label(s) at the peeling lip 116, the label-less backing strip may be received from the peeling lip 116 between the roller 106 and the receiving surface 118, and may then be received between the strip outfeed restraint 142 and the receiving surface 118. Apart from serving to maintain the backing strip adjacent the receiving surface 118, the strip outfeed restraint 142 also serves as a wedge/blade against which any extending length of the backing strip may be urged to tear it off.

As a result of the foregoing arrangement, when a roll of labels 200 is situated within the spool interior 110 (see FIG. 6), with a label-bearing strip 202 unspooling in a counter-clockwise direction against the feeding surface 114 (and between the strip infeed restraint 138 and the feeding surface 114), the label-bearing strip 202 emerges from a mouth 144 defined between the strip infeed restraint 138 and the peeling lip 116 (the mouth 144 being seen best in FIG. 1 and FIG. 2). The backing strip 204 may then be fed between the peeling lip 116 and the roller 106, and between the strip outfeed restraint 142 and the receiving surface 118. If a user then rolls the roller 106 along a substrate to which a label 206 is to be applied, with the peeling lip 116 trailing the roller 106 and being urged close to the substrate, the roller 106 will rotate and will grasp the backing strip 204 to feed it between the strip outfeed restraint 142 and the receiving surface 118. The roller's grasp on the backing strip 204 is enhanced if the roller 106 is allowed to translate inwardly toward the receiving surface 118 as a user presses the roller 106 against a substrate, thereby better pinching the backing strip 204 between the roller 106 and the receiving surface 118. Toward this end, the dispenser preferably includes a ridge 146 which extends between the dispenser sides 104 between the peeling lip 116 and the receiving surface 118—this ridge 146 being best seen in FIGS. 2, 4A, and 5A—and also extending adjacent the roller 106, whereby the roller 106 may be displaced toward the ridge 146 to pinch the backing strip 204 between the roller 106 and ridge 146. Thus, as the roller 106 rotates against the substrate to which the label 206 is to be adhered, it pulls the strip 202 so that it unspools from the spool interior 110 and between the strip infeed restraint 138 and the peeling lip 116. As the label-bearing backing strip 202 makes a nearly 180 degree turn about the peeling lip 116, any label 206 thereon will tend to peel off owing to its stiffness with respect to the backing strip 204, and it will then be applied to the substrate. The resulting label-less backing strip 204 will continue to be pulled by the roller 106 to feed between the strip outfeed restraint 142 and the receiving surface 118 so long as the roller 106 rotates.

Further advantages, features, and objects of the invention will be apparent from the remainder of this document in conjunction with the associated drawings.

DETAILED DESCRIPTION OF PREFERRED VERSIONS OF THE INVENTION

Figure 1:
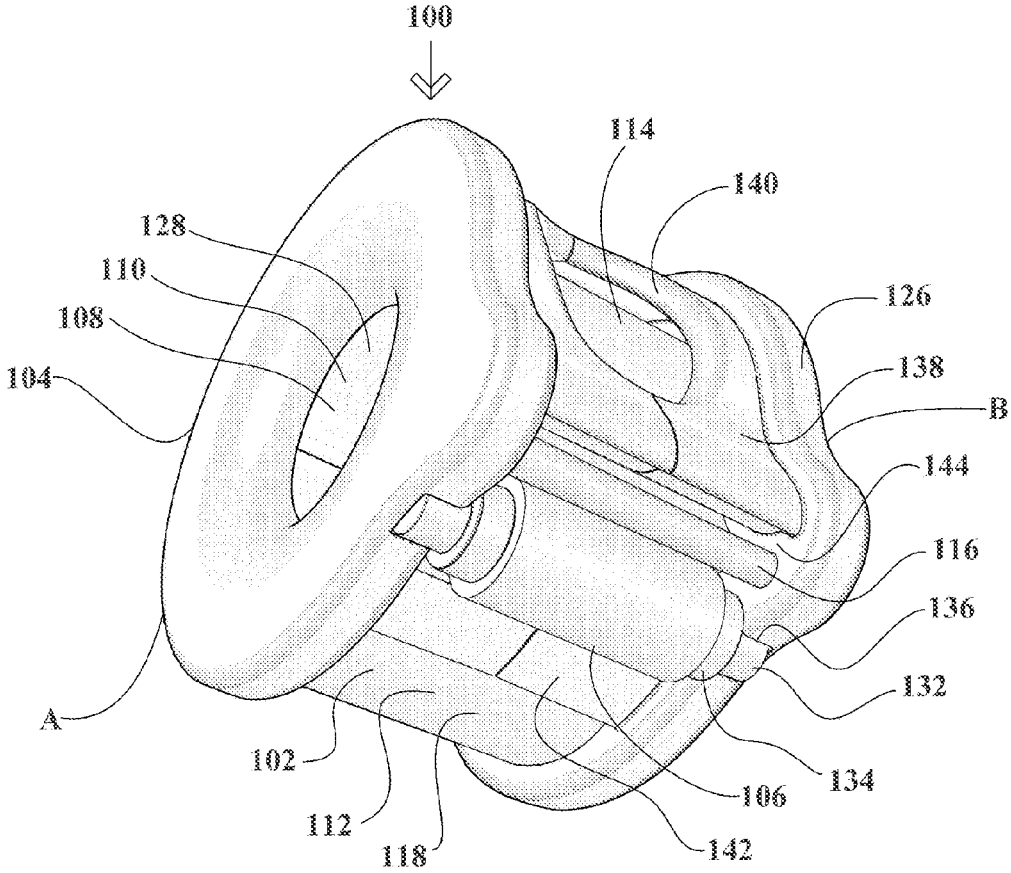
FIG. 1 is a perspective view of a preferred version of the label dispenser 100 in assembled form, showing the spool 102 and roller 106 extending between the dispenser sides 104, wherein a rolled label-bearing backing strip within the spool interior 110 may be unspooled against the feeding surface 114 and below the strip infeed restraint 138, about the peeling lip 116 (at which labels tend to peel off of the backing strip as the backing strip twists about the peeling lip 116), with the label-less backing surface then proceeding beneath the roller 106 and the strip outfeed restraint 142 against the receiving surface 118.
Figure 2:
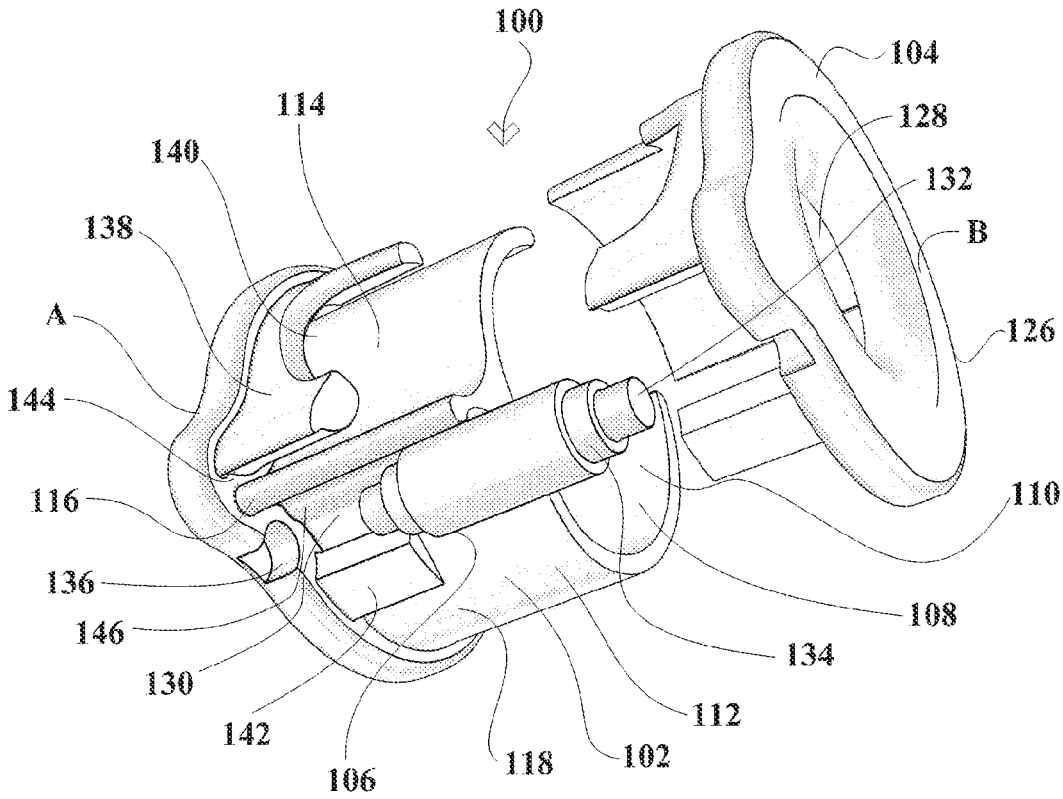
FIG. 2 is an exploded perspective view of the label dispenser 100 of FIG. 1, shown at an angle such that the roller 106 is in the foreground.
Figure 3:
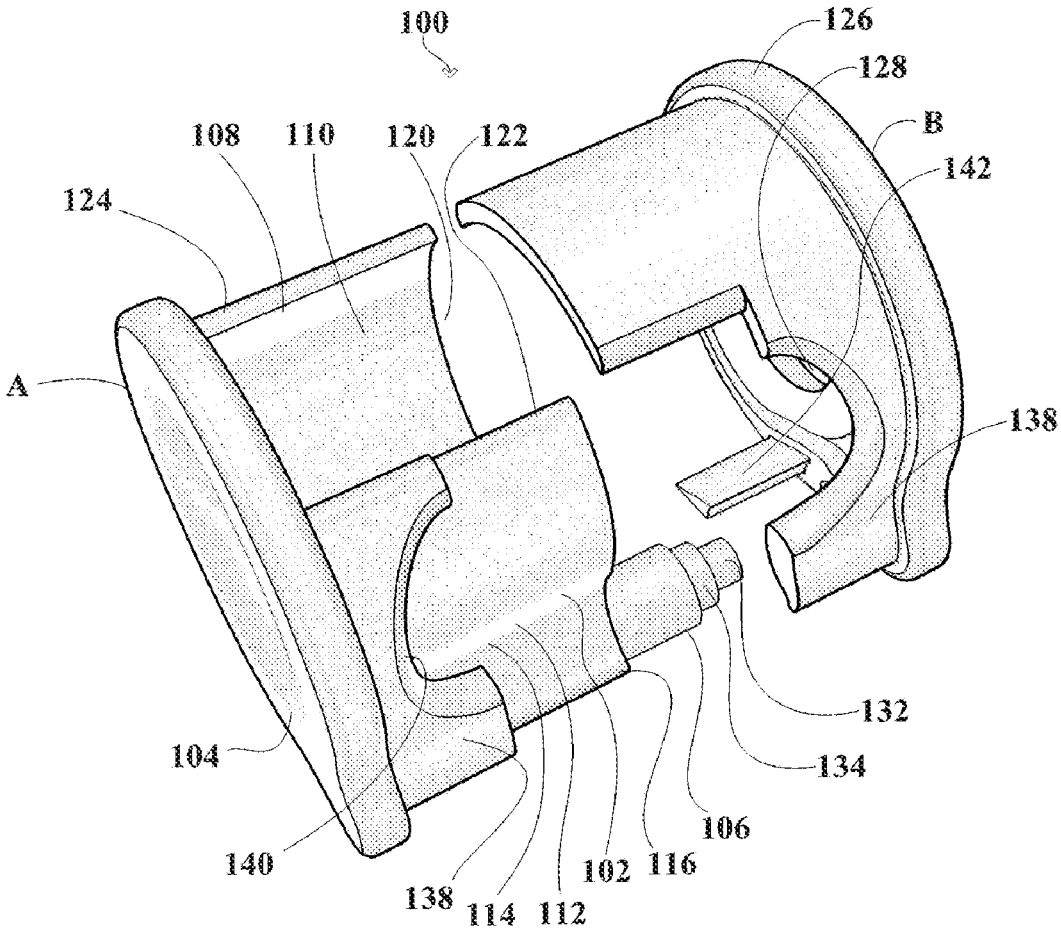
FIG. 3 is an exploded perspective view of the label dispenser 100 of FIG. 1, shown from another angle.
Figure 4A:
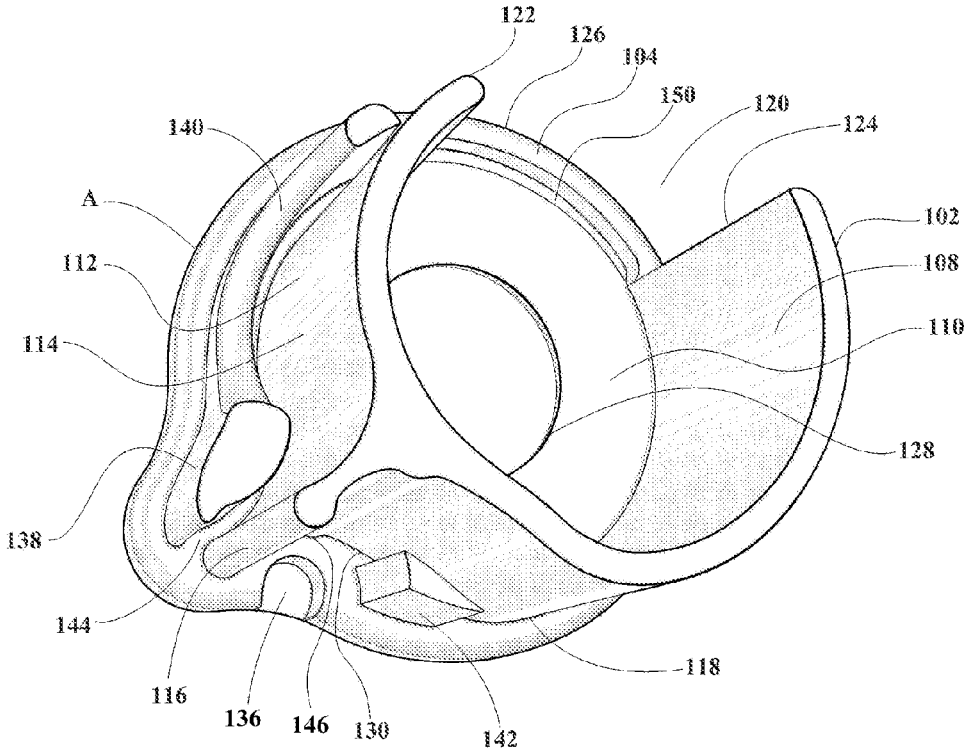
FIG. 4A is a perspective view of the right section of the label dispenser 100 of FIGS. 1-3 (shown without the roller 106 of FIGS. 1-3).
Figure 4B:
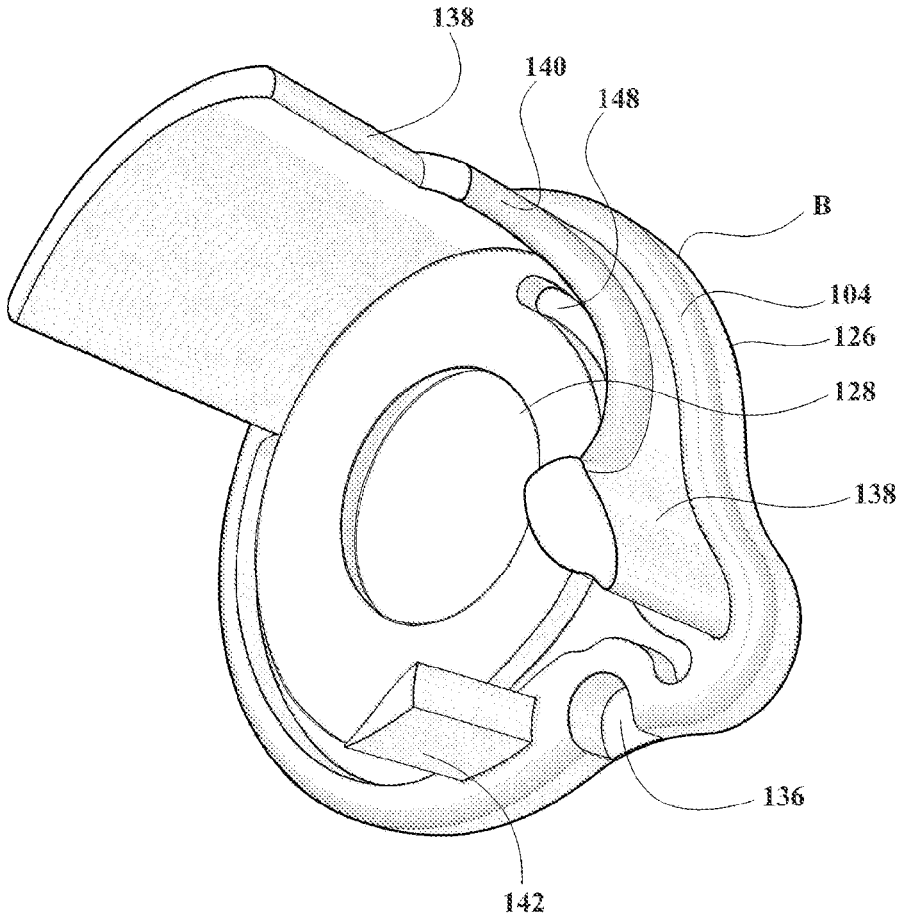
FIG. 4B is a perspective view of the left section of the label dispenser 100 of FIGS. 1-3 (shown without the roller 106 of FIGS. 1-3).
Figure 5A:
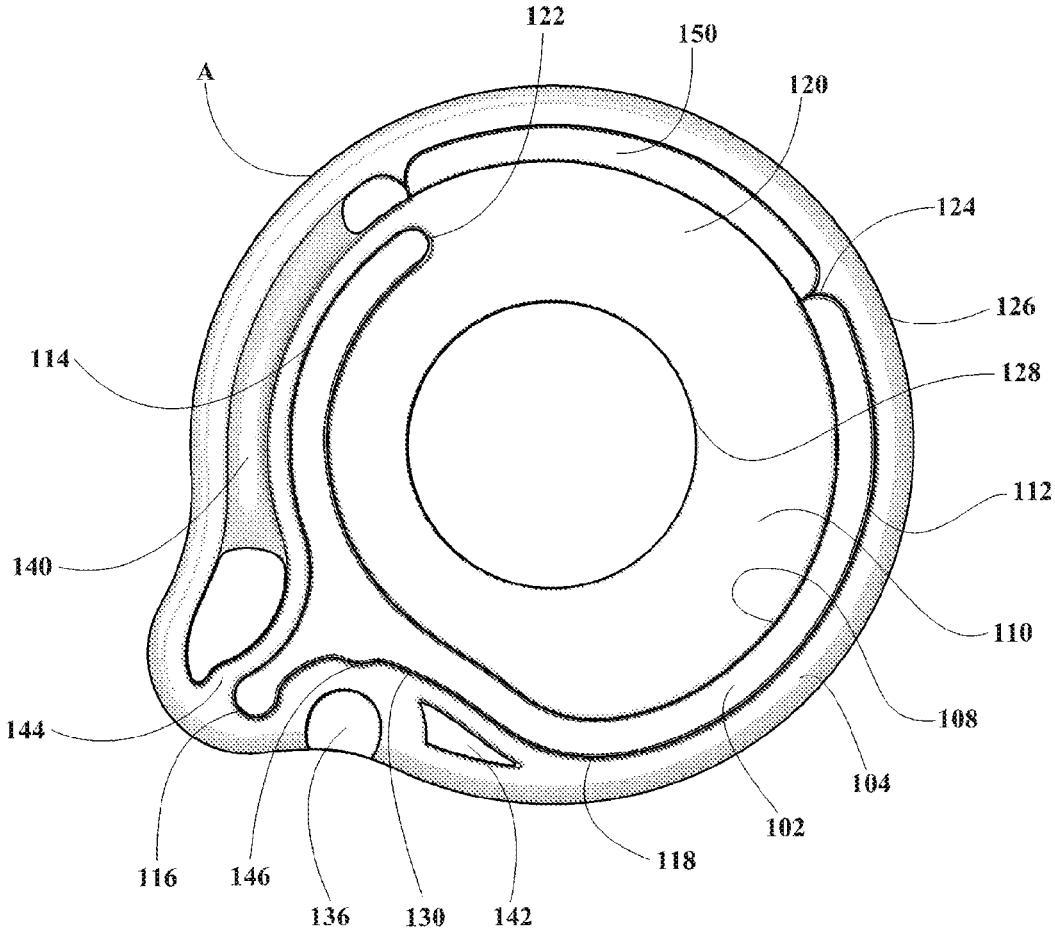
FIG. 5A is an elevational view of the right section of the label dispenser 100 of FIG. 4A (shown without the roller 106 of FIGS. 1-3).
Figure 5B:
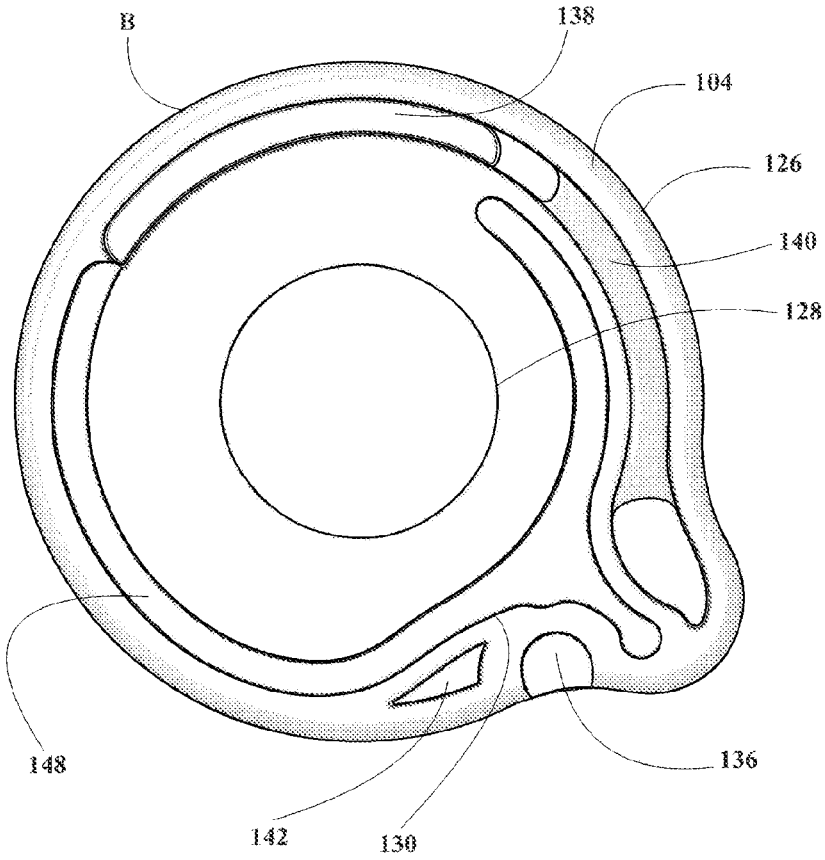
FIG. 5B is an elevational view of the left section of the label dispenser 100 of FIG. 4B (shown without the roller 106 of FIGS. 1-3).

To expand on the foregoing discussion, as can be seen from FIGS. 2, 3, 4A-4B, and 5A-5B, the label dispenser 100 is preferably formed in two (or more) sections, here labeled A and B, which allow a user to separate the sections and access the spool interior 110 to install and remove rolls of labels. As seen particularly in FIGS. 4A-4B and 5A-5B, this is accomplished in the illustrated dispenser by having the spool 102 (the feeding surface 114, peeling lip 116, and receiving surface 118)—all of which are found on section A—fit within a complementary slot 148 formed in section B. Additionally, section B bears a portion of the strip infeed restraint 138, and this is received within a complementary slot 150 defined in section A. However, the illustrated assembly/disassembly arrangement is merely exemplary, and the label dispenser 100 could be sectioned and assembled/disassembled in a variety of other ways instead.

In other versions of the invention, the sections A and B might be fixed together about a roll of labels after the roll is installed (as by gluing or otherwise fixing the sections together), and the dispenser might then be provided to users as a disposable unit to be discarded after one runs out of labels. Since one could (with difficulty) install a new roll of labels within the dispenser by inserting the roll into one of the central apertures 128 in the dispenser sides 104, the central apertures 128 might be omitted if the dispenser is intended to be non-reusable.

It is notable that the label dispenser 100 need not be operated in the manner discussed above to dispense labels, in that the dispenser need not be run over a substrate to dispense labels thereon. A user could simply actuate the dispenser by hand to eject labels from the mouth 144 of the dispenser, at which point the user can then apply the labels to substrates as desired. For example, the user might actuate the roller 106 with his/her thumb, and/or pull on the label-less backing strip extending from the receiving surface 118 and the strip outfeed restraint 142. As another option, a user might use the dispenser in such a manner that it dispenses labels without peeling them from their backing strip, as by feeding both the labels and the backing strip through the mouth 144 without then wrapping the backing strip about the peeling lip 116, and extending the backing strip between the roller 106 and the receiving surface 118.

The label dispenser 100 depicted in the drawings is preferably formed of durable plastic material, though metals, ceramics, or other materials could also or alternatively be used. Since the roller ends 132 preferably snap-fit into the cavities 136 in the dispenser sides 104 (see particularly FIGS. 1 and 2), if the dispenser sides 104 are made of metals or other relatively unyielding materials, it may be desirable to form at least the roller 106 from plastic materials. However, if the roller ends 132 are not to snap into the cavities 136—e.g., if the roller ends 132 are simply to be fit within the cavities 136 when the dispenser sections A and B are assembled from a state similar to that in FIGS. 2-3 to the state shown in FIG. 1—the entirety of the dispenser may be formed of unyielding material. The roller circumference 134 is preferably ensheathed or coated with an elastomeric or other friction-enhancing material to enhance the grip of the roller circumference 134 on the substrate and on the label-less backing strip.

Figure 6:
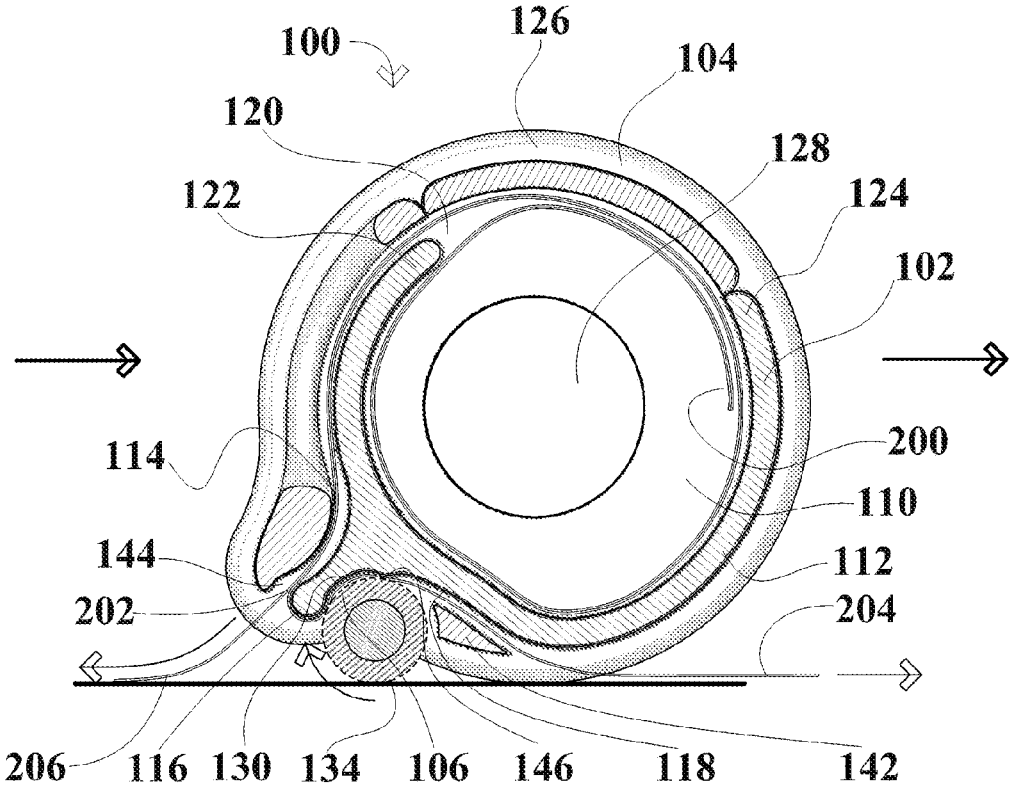
FIG. 6 is a schematic view of the label dispenser 100 of the foregoing drawings, illustrating the label dispensation process described above in reference to FIG. 1 with a number of labels 206 being shown on a backing strip 204 and being applied to a substrate, and with the roller circumference 134 being shown in phantom.

The invention is not limited to the label dispenser 100 shown in the drawings, which may be modified in a variety of ways. As one example, the strip outfeed restraint 142 might be made to extend about a substantial portion of the circumference of the spool 102, such that the label-less backing strip 204, rather than being ejected from the dispenser in the same direction in which the dispenser is traveling (see FIG. 6), instead ejects behind the dispenser and above the newly-applied labels 206. Additionally or alternatively, the strip infeed restraint 138 may be extended such that, in FIG. 6, it terminates more closely adjacent the substrate so as to further press down any label 206 applied to the substrate. As another example, the dispenser need not have the generally round shape seen (for example) in FIG. 6, and the dispenser might have a planar bottom which slides across the substrate. Additionally, multiple rollers 106 might be incorporated, as by installing rollers 106 on opposite sides of the strip outfeed restraint 142. Otherwise, the shapes/contours and sizes of various components of the label dispenser 100 shown in the drawings may be widely varied, such that the invention adopts an appearance vastly different from that of the exemplary label dispenser 100 shown in the drawings.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A label dispenser including:

a. a pair of opposing dispenser sides;

b. a spool extending between the dispenser sides, the spool including:

(1) an inner spool circumference bounding a hollow spool interior wherein a roll of labels may be situated; and (2) an outer spool circumference including:

(a) a feed opening extending from the inner spool circumference, through which a label-bearing strip may be unspooled from a roll of labels situated within the spool interior, wherein the feed opening is bounded on opposing sides by a first side and a second side which extend between the opposing dispenser sides;

(b) an outwardly protruding peeling lip;

(c) a feeding surface curving in a convex arc from the first side of the feed opening toward the peeling lip, against which a label-bearing strip unspooling from the spool interior may be fed; and (d) a receiving surface curving in a convex arc from the peeling lip toward the second side of the feed opening, against which a label-less strip may be received after being fed from the feeding surface and about the peeling lip, wherein a concave receiving region is defined between the peeling lip and the receiving surface;

c. a strip outfeed restraint extending between the dispenser sides adjacent the receiving surface, wherein a label-less strip received against the receiving surface may be received between the strip outfeed restraint and the receiving surface; and d. a roller extending adjacent the peeling lip within the concave receiving region, the roller having opposing roller ends rotatably mounted within the dispenser sides with a roller circumference extending therebetween.

2. The label dispenser of claim 1 wherein the dispenser sides are bounded by outer dispenser edges wherein:

a. a portion of the roller circumference extends inwardly from the dispenser edges toward the receiving surface, and b. the remainder of the roller circumference extends outwardly beyond the dispenser edges, whereby the roller protrudes from between the opposing dispenser edges.

3. The label dispenser of claim 2:

a. further including a ridge defined on the outer spool circumference adjacent the receiving surface, b. the roller ends are also translatably mounted within the dispenser sides, wherein the roller is translatable toward the ridge.

4. The label dispenser of claim 1 further including a strip infeed restraint extending between the dispenser sides and adjacent the feeding surface and peeling lip, wherein a label-bearing strip fed along the feeding surface may be received between the strip infeed restraint and the peeling lip.

5. The label dispenser of claim 4 wherein the receiving surface and strip infeed restraint curve extend along a shared spiral path.

6. A label dispenser including:

a. a pair of opposing dispenser sides;

b. a spool extending between the dispenser sides, the spool including:

(1) an inner spool circumference bounding a hollow spool interior wherein a roll of labels may be situated; and (2) an outer spool circumference including:

(a) a feed opening extending from the inner spool circumference, through which a label-bearing strip may be unspooled from a roll of labels situated within the spool interior, wherein the feed opening is bounded on opposing sides by a first side and a second side which extend between the opposing dispenser sides;

(b) an outwardly protruding peeling lip, wherein a pair of cavities are oppositely situated within the dispenser sides adjacent the peeling lip;

(c) a feeding surface curving in a convex arc from the first side of the feed opening toward the peeling lip, against which a label-bearing strip unspooling from the spool interior may be fed; and (d) a receiving surface curving in a convex arc from the peeling lip toward the second side of the feed opening, against which a label-less strip may be received after being fed from the feeding surface and about the peeling lip;

c. a strip outfeed restraint extending between the dispenser sides adjacent the receiving surface, wherein a label-less strip received against the receiving surface may be received between the strip outfeed restraint and the receiving surface; and d. a roller having opposing roller ends rotatably and translatably mounted within the cavities, wherein the roller is:

(1) rotatable within the cavities, and (2) translatable toward the outer spool circumference.

7. The label dispenser of claim 6 further including a ridge defined on the outer spool circumference adjacent the peeling lip and the receiving surface, wherein the roller is translatable toward the ridge.

8. The label dispenser of claim 6 further including a strip infeed restraint extending between the dispenser sides and adjacent the feeding surface and peeling lip, wherein a label-bearing strip fed along the feeding surface may be received between the strip infeed restraint and the peeling lip.

9. The label dispenser of claim 8 wherein the receiving surface and strip infeed restraint curve extend along a shared spiral path.

10. A label dispenser including:

a. a spool, the spool having an outer spool circumference which:

(1) follows an at least substantially cylindrical path, (2) has a peeling lip extending outwardly therefrom in a direction oriented at least substantially radially, b. a roller extending adjacent the peeling lip, the roller having opposing roller ends with a roller circumference extending therebetween;

c. a pair of opposing dispenser sides:

(1) having the spool extend therebetween;

(2) each bearing a cavity therein, wherein the roller ends are rotatably situated within the cavities;

(3) being bounded by outer dispenser edges wherein:

(a) a portion of the roller circumference extends inwardly from the dispenser edges toward the outer spool circumference, and (b) the remainder of the roller circumference extends outwardly beyond the dispenser edges, whereby the roller protrudes from between the opposing dispenser edges.

11. The label dispenser of claim 10 wherein the roller ends are also translatably situated within the cavities, whereby the roller is displaceable toward the outer spool circumference.

12. The label dispenser of claim 11 wherein the outer spool circumference includes a ridge thereon extending between the dispenser sides, the ridge being situated adjacent the roller.

13. The label dispenser of claim 10 wherein the spool further includes:

a. an inner spool circumference bounding a hollow spool interior wherein a roll of labels may be situated, b. a feed opening extending from the inner spool circumference to the outer spool circumference, wherein the feed opening is bounded by a first side and an opposing second side which extend between the dispenser sides.

14. The label dispenser of claim 13:

a. wherein the outer spool circumference is defined by:

(1) a feeding surface extending from the first side of the feed opening toward the peeling lip, (2) a receiving surface extending from the second side of the feed opening toward the peeling lip, b. wherein the roller extends adjacent the receiving surface, and c. further including a strip infeed restraint extending between the opposing dispenser sides, the strip infeed restraint being situated adjacent to, and spaced from, the feeding surface and peeling lip.

15. The label dispenser of claim 14 wherein the strip infeed restraint and the receiving surface extend along a shared spiral path.

16. The label dispenser of claim 13 wherein:

a. the outer spool circumference is defined by:

(1) a feeding surface extending from the first side of the feed opening toward the peeling lip, (2) a receiving surface extending from the second side of the feed opening toward the peeling lip, wherein a concave receiving region is defined between the receiving surface and the peeling lip;

b. the roller extends within the concave receiving region adjacent the receiving surface.

17. The label dispenser of claim 15 further including a strip outfeed restraint extending between the dispenser sides adjacent to and spaced from the receiving surface, with the roller being situated between the strip outfeed restraint and the peeling lip.

18. A label dispenser including:

a. a spool having (1) an outer feeding surface following a convex curve;

(2) a peeling lip extending outwardly from the outer feeding surface;

(3) an outer receiving surface following a convex curve, the outer receiving surface extending from the peeling lip in a direction opposite that of the outer feeding surface, wherein the outer feeding surface and outer receiving surface together define an at least substantially cylindrical surface, with the peeling lip extending at least substantially perpendicularly outwardly between the outer feeding surface and the outer receiving surface;

b. a roller rotatably mounted in a concave receiving region defined between the peeling lip and the outer receiving surface, the roller having opposing roller ends with a roller circumference situated therebetween;

c. a strip infeed restraint extending adjacent the outer feeding surface and peeling lip, wherein a label-bearing strip fed along the outer feeding surface may be received between the strip infeed restraint and the peeling lip.

19. The label dispenser of claim 18 wherein the receiving surface and strip infeed restraint curve at least substantially continuously along a shared spiral path.

20. The label dispenser of claim 18 further including a strip outfeed restraint extending within the concave receiving region, the strip outfeed restraint being adjacent to and spaced from the receiving surface and the peeling lip.

21. The label dispenser of claim 18 further including a pair of opposing dispenser sides:

a. having the spool extend therebetween;

b. each bearing a cavity therein, wherein the roller ends are rotatably situated within the cavities;

c. being bounded by outer dispenser edges wherein:

(1) a portion of the roller circumference extends inwardly from the dispenser edges toward the receiving surface, and (2) the remainder of the roller circumference extends outwardly beyond the dispenser edges, whereby the roller protrudes from between the opposing dispenser edges.

22. The label dispenser of claim 21 wherein the roller ends are also translatably situated within the cavities, whereby the roller may be displaced toward the receiving surface.

23. The label dispenser of claim 21 wherein the receiving surface includes a ridge extending between the dispenser sides, the ridge being situated adjacent the roller.

24. The label dispenser of claim 18 wherein the spool includes:

a. an outer spool circumference upon which the feeding surface, receiving surface, and peeling lip are defined, b. an inner spool circumference bounding a hollow spool interior wherein a roll of labels may be situated, c. a feed opening extending between the inner spool circumference and outer spool circumference, through which a label-bearing strip may be unspooled from a roll of labels situated within the spool interior.

* * * * *